United States Patent [19]

Asbury

[11] Patent Number: 4,662,696

[45] Date of Patent: May 5, 1987

[54] BATTERY JUMPER CABLES WITH SAFETY SWITCH

[76] Inventor: Cash G. Asbury, 1020 Jefferson Rd., Pittsburgh, Pa. 15235

[21] Appl. No.: 835,036

[22] Filed: Feb. 28, 1986

[51] Int. Cl.[4] ..... H01R 11/24

[52] U.S. Cl. ..... 339/29 B; 339/28

[58] Field of Search ..... 339/29 B, 32 R, 32 M, 339/31 R, 31 M, 28

[56] References Cited

U.S. PATENT DOCUMENTS

| | | | |
|---|---|---|---|
| 4,163,134 | 7/1979 | Budrose | 339/29 B |
| 4,420,212 | 12/1983 | Wright | 339/29 B |
| 4,431,925 | 2/1984 | Frisbee et al. | 339/29 B |
| 4,463,402 | 7/1984 | Cottrell | 339/29 B |
| 4,607,209 | 8/1986 | Guim et al. | 339/29 B |

*Primary Examiner*—Eugene F. Desmond
*Assistant Examiner*—Paula A. Austin
*Attorney, Agent, or Firm*—Reed Smith Shaw & McClay

[57] ABSTRACT

A pair of battery jumper cables are provided with a safety switch to eliminate serious injuries that can occur during the jumping of a dead or weakened battery because gases from the battery are ignited by a spark which results from the connection of a hot lead to a battery terminal. A durable, insulating safety switch is provided in one of the battery cables equi-distant from either end. The switch has a handle which when depressed makes electrical contact between the leads of the battery cable. Additionally, the switch is designed to maintain electrical contact between the battery terminals until the switch handle is completely released.

5 Claims, 5 Drawing Figures

BATTERY JUMPER CABLES WITH SAFETY SWITCH

BACKGROUND OF THE INVENTION

1. Field of the Invention

The present invention relates to the field of battery jumper cables or battery booster cables.

2. Description of the Prior Art

Jumper cables or booster cables have been used for years to enable one to use the good battery in one car to start the engine in another car which will not start because the battery in the latter car is run-down, weakened or dead. This starting process is commonly known as jump-starting. Typical battery jumper cables or battery booster cables are disclosed and described in *Consumer Reports,* Vol. 44, January 1979, pp. 42–46 and *Consumer Reports Buying Guide,* Vol. 44, December 1979, pp. 410–14. The terms jumper cables and booster cables are used interchangeably.

Battery jumper cables typically consist of two cables, each one being an insulated wire having a clamp at each end as shown in FIG. 1. To jump start a dead battery, one cable 7 is connected to positive terminal 3 of dead battery 1 and then to positive terminal 4 of good battery 2. The other cable 8 is connected to negative terminal 6 of good battery 2 and then to a suitable ground 5 in the car with dead battery 1. The final connection should be made to a suitable group 5 and not to negative terminal 9 of dead battery 1.

Connecting jumper cables, however, can be dangerous, even if the above procedure is used. A car battery emits combustible gases and connecting a jumper cable could produce a spark that could case an explosion. A battery explosion is especially dangerous because the acid inside the battery could splatter on one's skin or into one's eye causing permanent damage.

When connecting jumper cables, the final connection typically produces a spark. This spark is dangerous because the combustible gases emitted by the battery could be ignited. In the above-described procedure for connecting jumper cables, one tries to reduce the possibility of explosion by making the last connection to a suitable ground 5, slightly away from the battery. It would be desirable, however, to have a set of jumper cables in which the final connection occurs well away from the battery, completely eliminating the possibility of an explosion.

Prior art storage battery devices for starting vehicles have been equipped with a remote momentary contact switch. One such device is shown in U.S. Pat. No. 3,165,689. These storage battery devices, however, are designed for use on a tow truck by an experienced attendant and not by the public.

These devices also present additional problems. For example, the remote momentary contact switch shown in U.S. Pat. No. 3,165,689 only activates the additional circuitry which is used to connect the storage battery to the jumper cables. By itself, it does not complete the electrical circuit between the batteries. Final connection only occurs when a separate low power solenoid activates and closes a second switch located near the battery. Even with this device, there is still the danger of an explosion from a spark generated by the closing of the solenoid activated switch near the battery.

In the prior art procedure described above for jump starting a dead battery with jumper cables, the last connection is typically made by attaching the free end of cable 8, whose other end is attached to negative terminal 6 of good battery 2, to any unpainted part of the engine block in the car with dead or weakened battery 1. There is no guaranty, however, that a person will make the connection at a sufficient distance from the battery to insure that no explosion could take place. Similarly, because of the size of the engine compartment, it is only possible to remove the spark from the battery by at most a few feet with prior art jumper cables and the prior art attaching procedure.

It would be desireable, therefore, to have a set of battery jumper cables in which the final connection is made outside of either engine compartment, well away from the battery which could explode.

SUMMARY OF THE INVENTION

The present invention relates to an improved set of battery jumper cables for safely jump-starting a dead or weakened battery without the danger of igniting any gases emitted from the battery. A safety switch for making the final connection between one terminal of a good battery and one terminal of a dead or weakened battery is provided in one of the jumper cables. The switch is located away from either battery, typically midway between them. The switch is activated by a switch hangle which causes electrical contact to be made between two electrodes within the body of the switch, well away from either battery, thus preventing any explosion. In the unlikely event that an explosion should occur after the safety switch has been activated, the distance afforded the operator by the location of the safety switch away from either battery would minimize the possibility of serious injury to the operator.

The invention and its advantages will be apparent from the detailed description hereinafter and with reference to the accompanying drawings.

DESCRIPTION OF THE PREFERRED EMBODIMENTS

Figure 1:
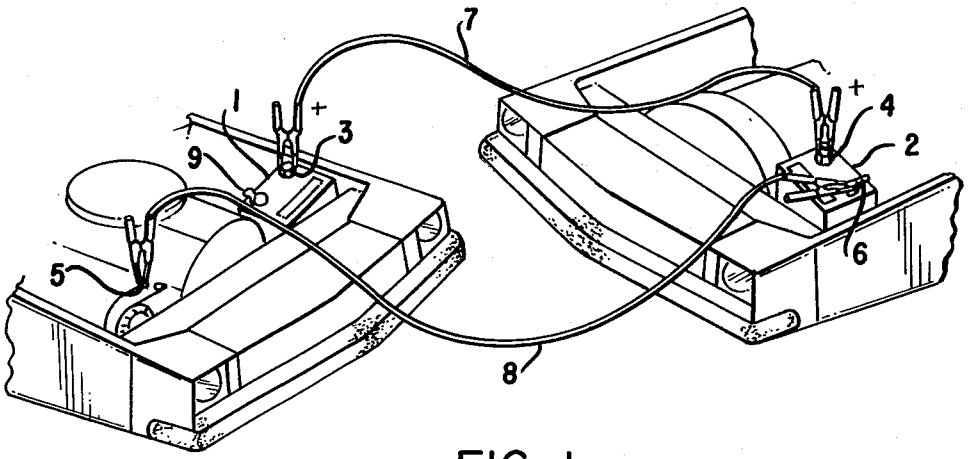
FIG. 1 PRIOR ART
FIG. 1 is a typical pair of prior art battery jumper cables shown in a typical prior art configuration for jump-starting a dead battery.
Figure 2:
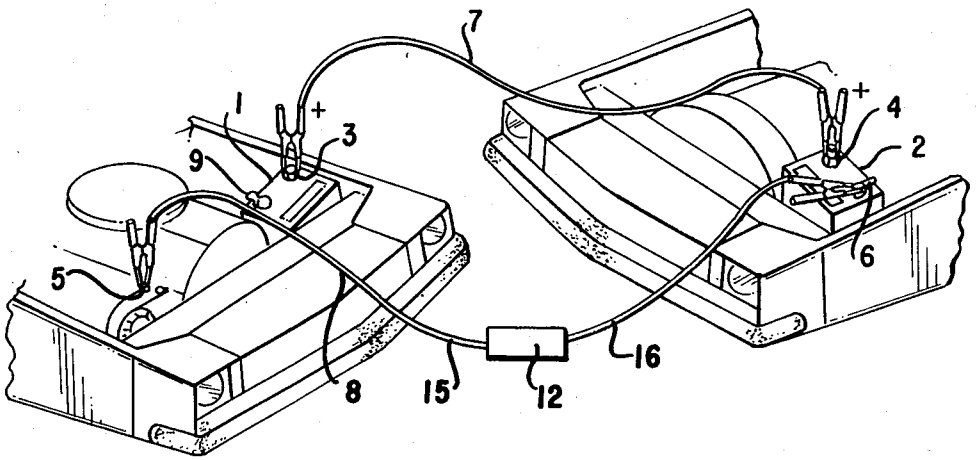
FIG. 2 shows a pair of battery jumper cables according to the present invention being used to jump-start a dead battery.

FIG. 2 shows a pair of battery jumper cables according to the present invention. Each jumper cable 7 and 8 consist of an insulated wire with a connecting means at each end. Typically the connecting means is a metal clip. The size of the insulated wire and the shape and structure of the metal clips are well known to those skilled in the art. To one of the jumper cables is added a battery booster safety switch 12. Preferably, safety switch 12 is equi-distant from either end of the jumper cable. It must also be capable of handling the currents which typically flow in jumper cables.

Figure 3:
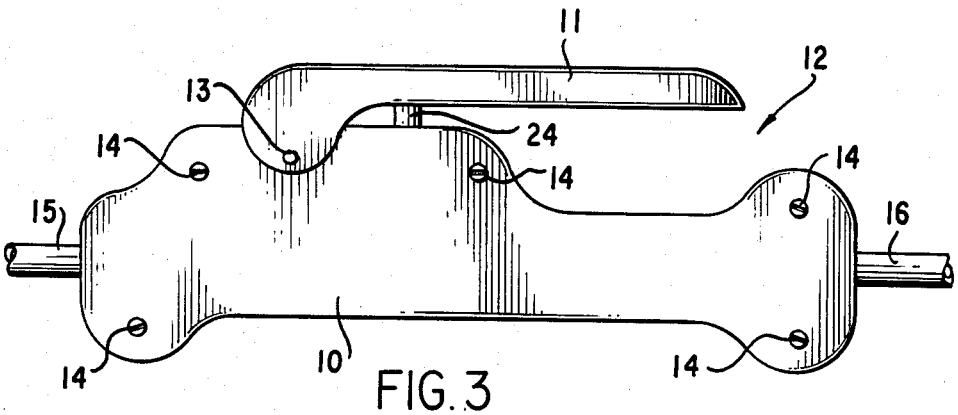
FIG. 3 shows a preferred embodiment of the safety switch 12.

FIG. 3 shows a close up of safety switch 12. Although this is a preferred embodiment of the battery booster safety switch, it is evident that many variations on the structure of this switch can be made while still accomplishing the desired function of making the final electrical connection between the two batteries at a safe distance from either battery, typically outside the engine compartment.

As shown in FIG. 3, battery booster safety switch 12 consists of a switch body 10 and a switch handle 11. Switch body 10 is about 6 inches in length and switch handle 11 is about 4 inches in length. Switch body 10 is made from an insulating material. Switch handle 11 can be made from either an insulating material or a noninsulating material and is connected to the top of switch body 10 by a pin 13 around which switch handle 11 pivots when it is depressed.

Preferably, switch body 10 is made of an insulating material such as bakelite while switch handle 11 is a piece of metal with curved edges. Switch body 10 consists of 2 parts which are held together by five screws indicated by the numeral 14. Each part of switch body 10 has recesses or indentations to receive the inner workings of the switch.

As shown in FIG. 2, one side of safety switch 12 is connected to a suitable ground 5 through section 15 of cable 8 while the other side of safety switch 12 is connected to negative terminal 6 of good battery 2 through section 16 of cable 8. The other jumper cable 7 is connected between positive terminal 3 of dead battery 1 and positive terminal of good battery 2. Of course, it is evident that these connections can be changed using the present invention. For example, there is no longer any need to connect one cable to a suitable ground. Direct connection may be made between the negative terminals 6 and 9. Similarly, safety switch 12 can be in either the cable connecting the positive terminals or the negative terminals.

Figure 4:
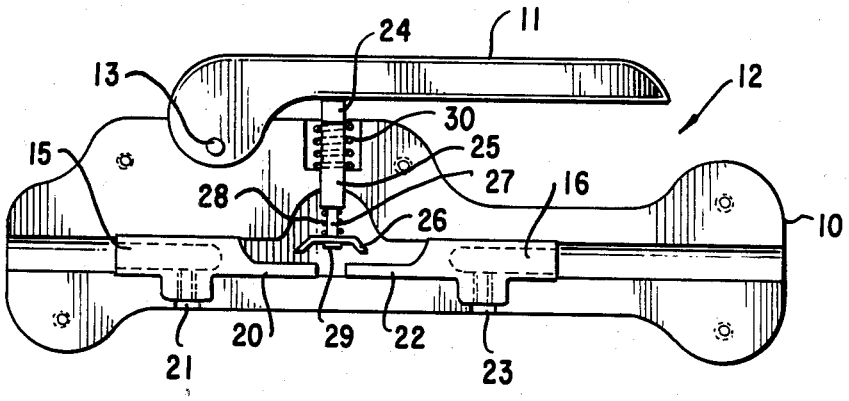
FIG. 4 shows a cut-away view of a preferred embodiment of the safety switch 12 shown in FIG. 3.

As shown in FIG. 4, one end of cable section 15 is inserted into switch body 10 and is electrically connected to electrode 20. One end of cable section 16 is inserted into switch body 10 and is electrically connected to electrode 22.

Preferably, the electrical connections to electrodes 20 and 22 are by means of set screws 21 and 23, respectively, located at the bottom of each electrode. Access to set screws 21 and 23 through the bottom of switch body 10 provides for ease of connection and removal of cable sections 15 and 16. Connection can be made by this means without taking switch 12 apart. Thus, a prior art pair of battery jumper cables could easily be retrofitted with safety switch 12.

This retrofitting could be done by cutting an existing jumper cable in half, removing the insulation from the cut ends, and inserting one cut end into switch body 10 making contact with electrode 20 and inserting the other cut end into switch body 10 making contact with electrode 22. By tightening set screws 21 and 23, electrical connection will be made between each cable end and each electrode. Additionally, set screws 21 and 23 will hold the cable ends in place to prevent the electrical connection from being broken.

As shown in FIG. 2, to jump-start a dead battery using the present invention, preferably, jumper cable 7, without safety switch 12, is connected between positive terminal 3 of dead battery 1 and positive terminal 4 of good battery 2. Then jumper cable 8, with safety switch 12, is connected between negative terminal 6 of good battery 2 and either negative terminal 9 of dead battery 1 or a suitable ground 5. No spark can occur during any of these connections because the safety switch is open. After these connections are made, the final electric contact occurs at a safe distance from either battery, typically outside the engine compartment, at safety switch 12 by depressing switch handle 11.

When switch handle 11 is depressed, it presses on insulating top part 24 of plunger rod 25 and forces plunger rod 25 down. Plunger rod 25 has an electrical connector 26 slideably attached to bottom part 27 of plunger rod 25 by means of a spring 28 and a retainer washer 29. Normally spring 28 keeps electrical connector 26 pressed against retainer washer 29 at the bottom of plunger rod 25. As plunger rod 25 moves, connector 26 moves the same amount until it makes contact with electrodes 20 and 22 inside switch body 10 and completes the electrical circuit.

A spring 30 located around plunger rod 25 and beneath insulating top part 24 returns plunger rod 25 and connector 26 to the unconnected or open position when switch handle 11 is released, thus breaking the electrical connection between the two batteries.

Connector 26 is typically a 14-gauge solid copper connector. Spring 28 allows the electrical connection between connector 26 and electrodes 20 and 22 to be maintained, even though a uniform pressure is not maintained on switch handle 11. This eliminates the possibility of electrical arching inside the handle.

Figure 5:
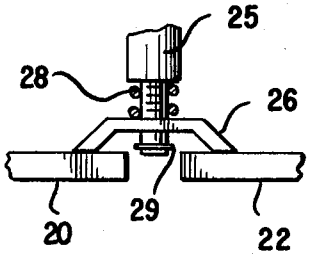
FIG. 5 is a close-up of the electrical contact area shown in FIG. 4.

Electrical contact is maintained because connector 26 is slideably attached to bottom part 27 of plunger rod 25. As shown in FIG. 5, plunger rod 25 continues to move downward compressing spring 28 even after electrical contact with electrodes 20 and 22 has been made. If switch handle 11 is released slightly, causing plunger rod 25 to move upward, spring 28 holds connector 26 in contact with electrodes 20 and 21 until plunger rod 25 has moved upward to the point that retaining washer 29 lifts connector 26 off of electrodes 20 and 22, breaking electrical contact.

While presently preferred embodiments of the invention have been described and shown in the drawings with particularity, the invention may be otherwise embodied within the scope of the appended claims.

What is claimed is:

1. In a pair of battery jumper cables having a safety switch in one of the cables, the improvement comprising:

a switch body made from an insulating material and having a cavity;

a switch handle at the top of the switch body and pivotably connected thereto;

a pair of electrodes extending into the cavity and connected to one of the cables;

a plunger rod extending from the top through the switch body and into the cavity; and an electrical connector located within the cavity and slidably attached to a bottom portion of the plunger rod, wherein depression of the switch handle pushes the plunger rod downwardly causing the electrical connector to contact the electrodes thereby closing the switch, and wherein partial release of the switch handle does not break the electrical contact between the electrical connector and the electrodes but full release does.

2. The device as described in claim 1 wherein the plunger rod is spring loaded to break electrical contact between the electrical connector and the electrodes when sufficient pressure is removed from the switch handle.

3. The device as described in claim 2 wherein the electrical connector is spring loaded to maintain electrical contact with the electrodes even if the plunger moves slightly upward but not as far as its open position.

4. The device as described in claim 3 wherein the safety switch is equi-distant from the outside ends of the cable.

5. The device as described in claim 4 wherein the insulating material is bakelite.

* * * * *